United States Patent [19]

Belt

[11] 4,149,346

[45] Apr. 17, 1979

[54] BUILDING CONSTRUCTION, AND METHOD

[76] Inventor: Wesley D. Belt, 10553 Rountree Rd., Los Angeles, Calif. 90064

[21] Appl. No.: 812,570

[22] Filed: Jul. 5, 1977

[51] Int. Cl.[2] ..... E04B 1/32

[52] U.S. Cl. ..... 52/81

[58] Field of Search ..... 52/81, 82, 80, 86, DIG. 10, 52/281

[56] References Cited

U.S. PATENT DOCUMENTS

| | | | |
|---|---|---|---|
| 2,733,784 | 2/1956 | Berry | 52/81 |
| 2,736,072 | 2/1956 | Woods | 52/81 |
| 3,043,054 | 7/1962 | Schmidt | 52/81 |
| 3,314,199 | 4/1967 | Wulf | 52/82 |
| 3,394,508 | 7/1968 | Burke | 52/82 |
| 3,485,001 | 12/1969 | Miller | 52/281 |
| 3,945,160 | 3/1976 | Grosser | 52/81 |
| 4,048,770 | 9/1977 | McKenzie | 52/81 |

OTHER PUBLICATIONS

Geodesics, by E. Popko, ©1968, by U. of Detroit Press.

*Primary Examiner*—Ernest R. Purser
*Assistant Examiner*—Henry Raduazo
*Attorney, Agent, or Firm*—Gene W. Arant

[57] ABSTRACT

In a building construction having adjacent wall panel sections which are joined together at an exterior angle exceeding 180 degrees, an improved means is provided for supporting and joining the wall sections. A metallic channel member forms a portion of the joining edge of each wall section. Each channel member has one side wall which is bent inwardly towards its base section, and this inwardly bent side wall is secured underneath the exterior panel member so that the base section of the channel member in cooperation with the joining edge of the exterior panel member forms a substantially continuous joining surface.

2 Claims, 5 Drawing Figures

BUILDING CONSTRUCTION, AND METHOD

BACKGROUND OF THE INVENTION

A building structure resembling an igloo may be formed from a number of flat wall sections that are of triangular or other non-rectangular configurations. A United States patent issued to Buckminster Fuller, now expired, has identified this type of structure as a geodesic dome. A more recent patent relating to this type of structure is U.S. Pat. No. 3,925,940.

In this type of structure each wall section includes an exterior panel member which is flat and relatively thin, and whose sides are cut to a triangular or other non-rectangular polygonal configuration. The wall section also includes several supporting beams. Each supporting beam is secured underneath the exterior panel member along one of its lateral edges. Adjacent wall sections of the completed structure are then secured together, not by direct securement of the exterior panel members, but by direct securement of the underlying beams which support them.

The object and purpose of the present invention is to provide a new and more economical structure of the foregoing type, as well as a method for making it.

SUMMARY OF THE INVENTION

According to the invention an exterior panel member of a deodesic dome structure is supported by means of beams secured underneath its lateral edges. Each of the beams is a metallic channel member. One side wall of the channel member is bent inwardly and is secured underneath the panel member, so that the channel member then provides a joining surface for the wall section which lies at an appropriate angle relative to the external surface of the panel member.

More specifically, two adjacent wall sections are to be joined with an exterior angle between their outer surfaces of (180+X) degrees. Each corresponding panel member has a straight joining edge formed along one side thereof.

An elongated metallic channel member is utilized which has a central base section and two upstanding side walls. One of the side walls is bent inwardly towards the central base section at an angle of (90−(X/2) degrees relative thereto. The inwardly bent side wall of the channel member is placed in engagement with the inner surface of the panel member, so that the under surface of the central base section of the channel member cooperates with the flat surface of the joining edge of the panel member to form a substantially continuous joining surface. The side wall of the channel member is secured to the panel member to retain this positional relationship.

Two adjacent wall sections as described in the preceding paragraph are then brought into abutting relationship. The base sections of the two channel members are then secured together.

DRAWING SUMMARY

PREFERRED EMBODIMENT

(FIGS. 1-4)

Figure 1:
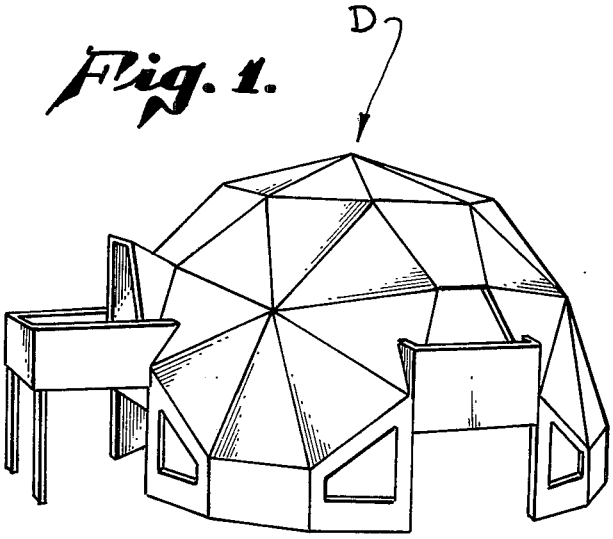
FIG. 1 is a perspective view of deodesic dome structure that may be built utilizing my invention.
Figure 2:
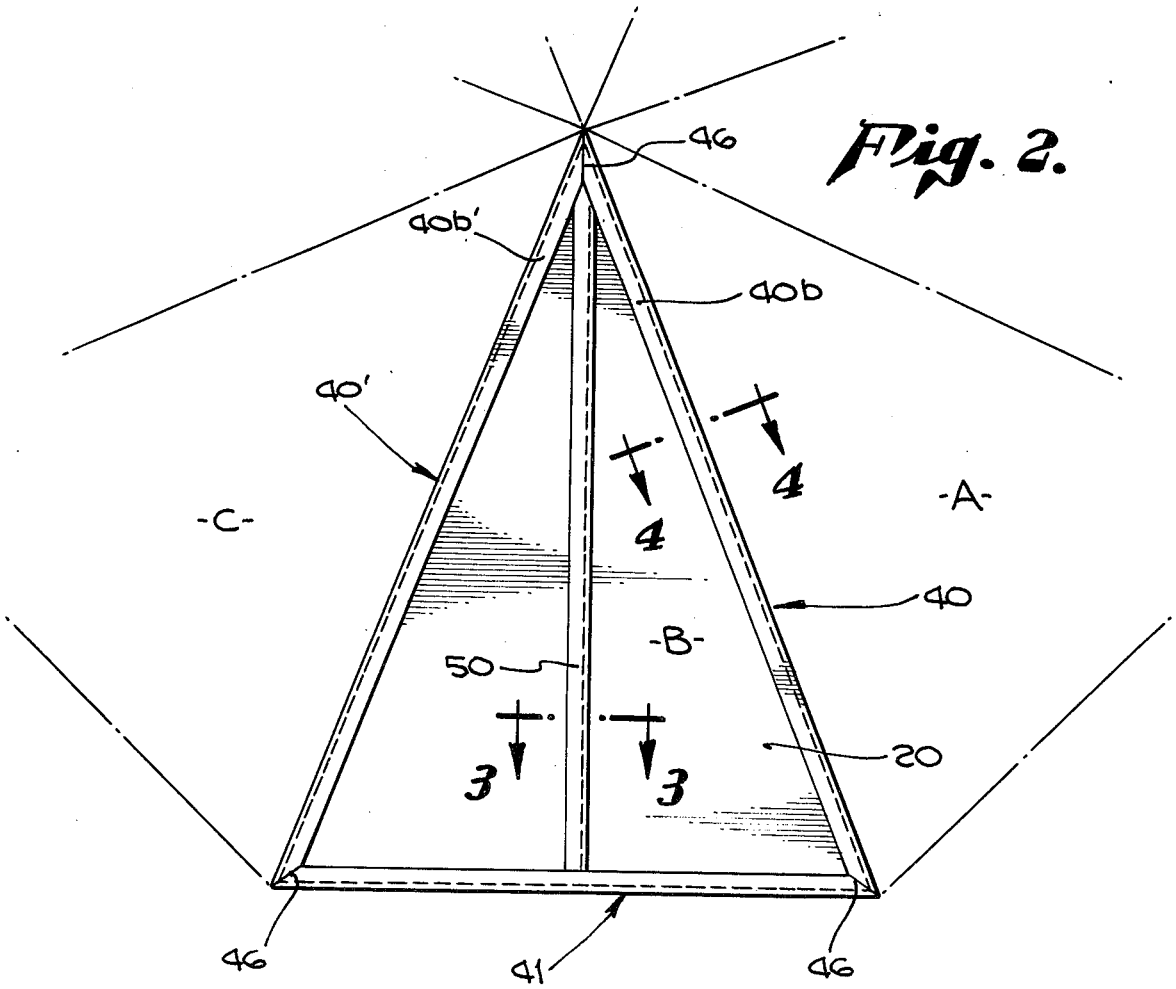
FIG. 2 is an enlarged interior view of a portion of the wall structure of the building shown in FIG. 1.

The geodesic dome D shown in FIG. 1 is made of a number of wall panel sections which are of triangular or other non-rectangular polygonal configurations. FIG. 2 is an interior view of three triangular wall panel sections A, B, and C. Sections A and B are joined together, and sections B and C are joined together.

Figure 4:
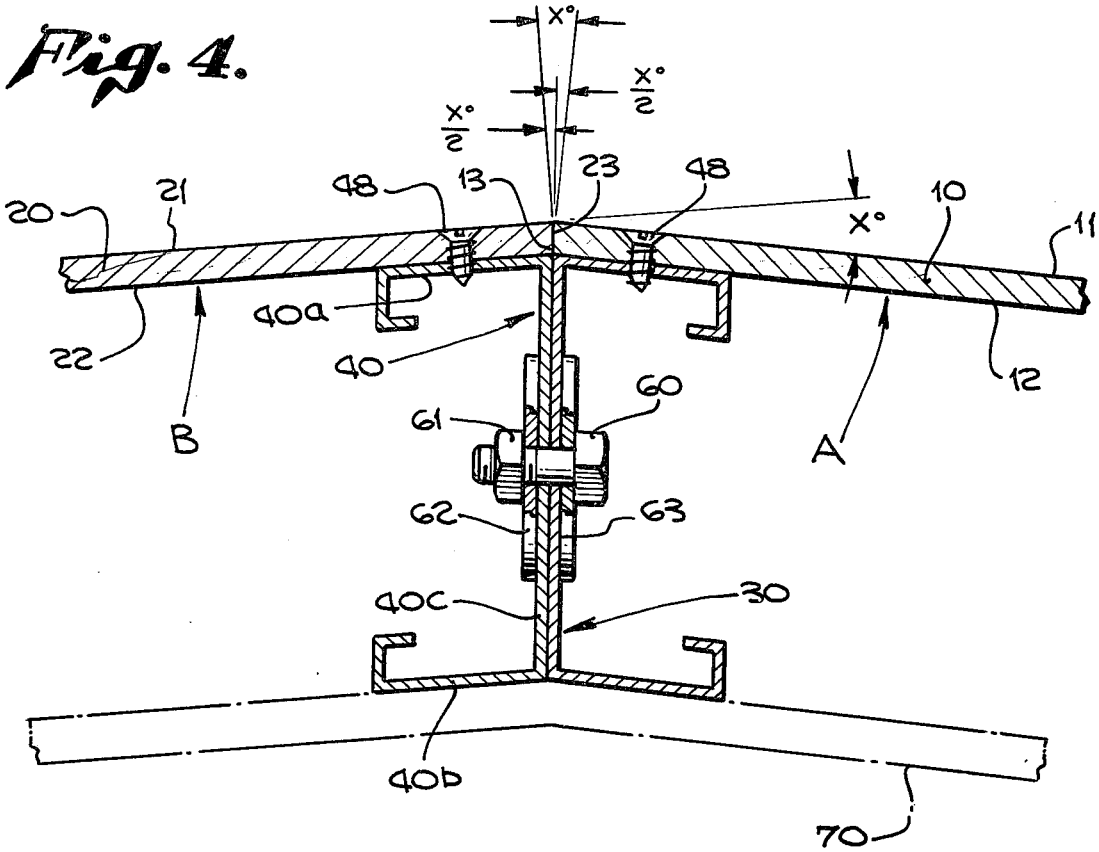
FIG. 4 is a cross-sectional view taken on the line 4—4 of FIG. 2, further enlarged like FIG. 3, and showing two wall sections joined together.

Referring now specifically to FIG. 4, the adjoining edges of panel wall sections A and B are there illustrated, as well as the details of the structure by which they are joined. Wall section A includes an exterior panel member 10 which is of triangular configuration, and a set of three beams 30 which are secured underneath the joining edges of the panel member. In similar fashion, wall section B includes an exterior panel member 20 that is of triangular configuration, and a set of three supporting beams 40 which are secured beneath the joining edges of the panel member. Each of the beams 30 and 40 is formed from a single metallic channel-shaped member.

As shown in FIG. 4, panel member 10 is a thin flat member, preferably made of wood or plastic material, and having flat outer and inner surfaces 11, 12, respectively. Panel member 20 is similarly constructed and has outer and inner surfaces 21, 22, respectively. Panel member 10 has along the left-hand side thereof, as seen in FIG. 4, a straight joining edge with a flat surface 13 which is angled at (90+(X/2) degrees to the outer surface 11. In similar fashion, panel member 20 has on its right-hand side as seen in FIG. 4 a straight joining edge with a flat surface 23 which is angled at (90+(X/2) degrees to the outer surface 21.

In the joined relationship of the wall sections A and B, as shown in FIG. 4, the edge surfaces 13 and 23 are in abutting relationship. Therefore, the exterior angle between the outer surfaces 21, 11 of the panel members 20, 10, respectively, is (180+X) degrees.

Referring now to FIG. 2 in conjunction with FIG. 4, the wall section B will be more specifically described. As best seen in FIG. 2, the panel member 20 has the form of an equilateral triangle. Channel member 40 provides a supporting beam underneath the right-hand side of the panel member while channel member 40' provides a supporting beam under the left-hand side. A channel member 41 provides a supporting beam underneath the lower and shorter side of the panel member. Both ends of each of the channel members are cut at a longitudinal angle, so that the three channel members will fit together, and the tapered ends are then welded along the weld lines 46. A central supporting beam 50, shown more specifically in FIG. 3, extends down the center of the panel member 20. Its upper end is joined to the ends of the beams 40 and 41' while its lower end is joined to the lateral center of beam 41.

As shown in FIG. 4, the metallic channel member 40 has side walls **40*a* and 40*b* and a flat central base section 40*c*. However, the side walls are not exactly perpendicular to the base section. Side wall 40*a* is bent inwardly so that it lies at an angle of (90−(X/2) degrees relative to the central base section 40*c*** of the channel member.

Side wall 40b is bent outwardly so that it lies at an angle of (90+(X/2) degrees relative to the central base portion. The inwardly bent side wall 40a abuts directly against the inner surface 22 of panel member 20. The exterior surface of the central base section 40c of channel member 40 cooperates with the angled edge surface 23 of panel member 20 to form a continuous flat joining surface. As will be understood by reference to FIG. 4, this continuous flat joining surface lies at an exterior angle of (90+(X/2) degrees relative to the flat outer surface 21 of panel member 20.

Although not specifically shown, it will be understood that each of the channel members 40' and 41 also has a side wall which is bent inwardly and which is attached to the under surface 22 of panel member 20, while also having another side wall that is outwardly bent and is positioned remote from the panel member 20.

Figure 3:
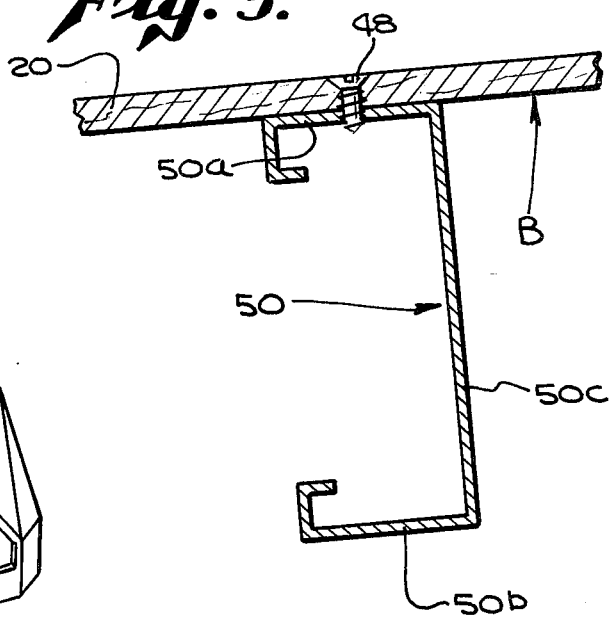
FIG. 3 is a cross-sectional view taken on the line 3—3 of FIG. 2, on a further enlarged scale, and showing a portion of the internal structure of one of the wall sections.

Channel member 50, shown in FIG. 3, has side walls 50a, 50b which are precisely perpendicular to its central base portion 50c. Channel member 50 is not directly involved in the joining of two adjacent panel sections together, but is used only as an internal reinforcement for the structure of the individual panel section B. Although not specifically shown in the drawings, it will be understood that at the tapered ends of channel members 40 and 40' which are welded together, a greater amount of material is cut from the outwardly bent side walls 40b, 40b' than is cut from the inwardly bent side walls 40a, 40a'. The reason for this is the angled relationship of the central base parts of the channel members 40 and 40' relative to the central base section of the channel member 50.

In order to create the fully assembled wall section B the abutting side walls of the channel members are secured to the panel member 20. For example, a series of screws 48 as shown in FIG. 4 may be driven through the exterior surface 21 of panel member 20, through the thickness of the panel member, and hence into and through the inwardly bent side wall 40a of channel member 40. The inwardly bent side walls of all of the channel members 40, 40' and 41 are secured to panel member 20 in this or any desired equivalent fashion. The upper side wall 50a of channel member 50 is likewise secured to the panel member 20.

When the wall sections A and B are each fully assembled in the manner described they are then placed in adjoining relationship as shown in FIG. 4. A series of fastening holes are then drilled through the central base section of the channel members 30 and 40. Alternatively, the joining holes may be drilled as part of the factory operation in prefabricating each individual panel section. At each pair of holes a bolt 60 secured by a nut 61 is passed through the central base section of the two channel members. To provide adequate structural support of the channel members, and prevent the bolts from tearing out, large flat metal washers 62, 63 are also used. Thus the washer 63 is placed inside the channel member 30, washer 62 is placed inside the channel member 40, bolt 60 is passed through both washers as well as the base section of both the channel members, and then the bolt is secured by means of its mating nut 61.

It is greatly preferred that each channel member have a curled edge on each of its side walls, as shown, to provide necessary structural rigidity. Both edges curl inwardly towards the base section.

An interior finish wall 70, indicated by dotted lines in FIG. 4, may if desired be added to the structure. The outwardly bent configuration of the inwardly disposed side wall of each of the channel members then provides a parallel set of supporting surfaces for interior panel members which may then be disposed in precisely parallel relationship to the corresponding outer wall members of the various panel sections. It will be understood, of course, that the length and breadth of the interior panel members will generally be somewhat smaller than for the corresponding exterior panel members.

METHOD OF FABRICATION

The channel members 30, 40 are presently manufactured as standard channel members having side walls that are precisely perpendicular to the central base part. As a separate operation, one side wall is bent inwardly by an angle of X/2 degrees while the other side wall is bent outwardly through the same angle. Fastener holes are formed at the desired locations. Then the tapered ends of the various channel members are cut at the necessary angles so that a set of three channel members fit together in the desired configuration. The set of channel members may then be welded together, and the corresponding panel member is fastened to them subsequently.

ALTERNATE FORM

Figure 5:
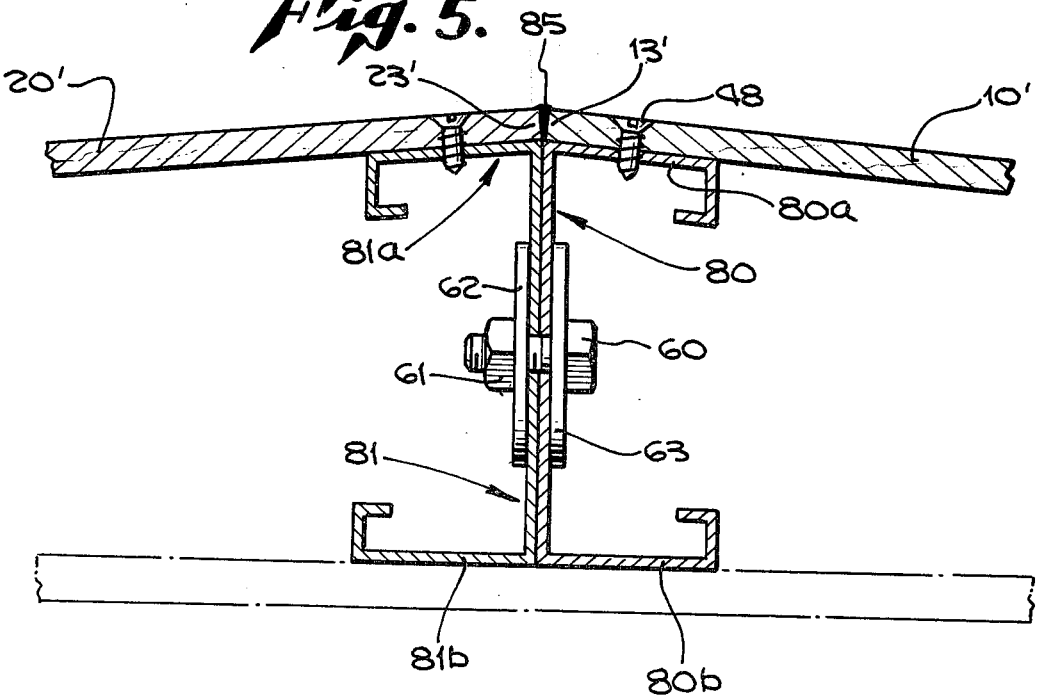
FIG. 5 illustrates a modified form of the structure of FIG. 4

Referring to FIG. 5, the channel member 80, 81 may be formed with one inwardly bent side wall while the other side wall remains at its normal position of perpendicularity to the central base part. The essential requirement in accordance with the present invention is that the side wall of the channel member that is to be fastened to the exterior panel member must be bent inwardly by the appropriate angle. If not interior wall panel is to be attached to the channel members, it is unnecessary to bend the interior side walls of the channel members. Even if an interior panel structure is to be attached, it is not essential that the interior panels be precisely parallel to the exterior panels.

As also shown in FIG. 5, panel 20' has a perpendicular joining edge surface 23' while panel 10' has a perpendicular joining edge surface 13'. The V-shaped space between these edges is filled with caulking material 85. Construction of the panel members in this fashion is more economical than using the sloped edges shown in the previous embodiment, and for that reason is probably preferred.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A frame for a flat triangular wall section of a geodesic dome structure in which (X+180) degrees is the exterior angle at which adjacent wall sections are joined together, the value of X being greater than zero but small compared to 90, comprising, in combination:

three generally channel-shaped metal frame members, each having a flat central base section, a first flat side wall inclined at an angle of (90−(X/2)° to said base section, and a second flat side wall inclined at an angle of (90+(X/2)° to said base section;

each of said side walls being curled in towards said base section;

all three of said first flat side walls being disposed in a common plane, and each end of each of said frame members being cut perpendicular to said plane and at an acute angle relative to the adjacent end of the associated base section so that the adjacent ends of said frame members are in mating engagement; and the adjoining ends of said frame members being fastened together;

whereby an exterior panel member may be supported upon and fastened to said first side walls and an interior finish panel member may be supported upon and fastened to said second side walls.

2. A triangular wall section including the frame of claim 1, and a triangular exterior panel member supported upon and fastened to said first side walls of all three of said frame members.

* * * * *